US005984883A

United States Patent [19]

Elnar

[11] Patent Number: 5,984,883

[45] Date of Patent: Nov. 16, 1999

[54] NECK MASSAGER FOR USE IN SPAS

[76] Inventor: Joseph G. Elnar, 40142 Ravenwood Dr., Murrieta, Calif. 92562

[21] Appl. No.: 08/911,041

[22] Filed: Aug. 14, 1997

Related U.S. Application Data

[63] Continuation-in-part of application No. 08/841,919, Apr. 8, 1997, abandoned.

[51] Int. Cl.[6] ..... A61H 15/00; A61H 23/04; A61H 33/00; A47K 3/12

[52] U.S. Cl. ..... 601/86; 601/88; 601/113; 601/134; 4/546; 4/575.1

[58] Field of Search ..... 601/52, 118, 127, 601/128, 130, 122, 126, 85–87, 89, 90, 94, 95, 112, 113, 63, 61, 135, 134, 133, 116, 115, 154, 158, 148, 149, 150, 107, 108, 88; 4/546, 975.1, 606

[56] References Cited

U.S. PATENT DOCUMENTS

| | | | |
|---|---|---|---|
| 2,384,427 | 9/1945 | Andis | 128/57 |
| 3,322,117 | 5/1967 | McCaw | 128/33 |
| 5,183,034 | 2/1993 | Yamasaki et al. | 128/36 |
| 5,695,451 | 12/1997 | Kawakami | 601/84 |

FOREIGN PATENT DOCUMENTS

| | | | |
|---|---|---|---|
| 0056601 A2 | 7/1982 | Germany | 601/113 |
| 3436-389 | 4/1986 | Germany | 601/113 |
| 1732982-A1 | 5/1992 | Germany | 601/126 |
| 4-114330 | 3/1991 | Japan | 601/112 |

*Primary Examiner*—Danton D. DeMille
*Attorney, Agent, or Firm*—Edgar W. Averill, Jr.

[57] ABSTRACT

A neck massager for mounting in the sidewall of a spa. The neck massager is enclosed in a housing which holds an electric motor with a drive shaft. The drive shaft is connected through gears to a pair of massage arms each of which have offset knobs at the end thereof. The knobs are covered by a flexible diaphragm and the device is mounted in the sidewall of a spa in such a way that it may be contacted by a user's neck.

4 Claims, 10 Drawing Sheets

NECK MASSAGER FOR USE IN SPAS

CROSS REFERENCE TO RELATED APPLICATIONS

This application is a Continuation-In-Part of my co-pending application Ser. No. 08/841,919, filed Apr. 8, 1997 now abandoned.

BACKGROUND OF THE INVENTION

The field of the invention is muscle massagers and the invention relates more particularly to neck and shoulder massagers of the type which tend to be used with spas, hot tubs or whirlpool baths.

A hydro-massage unit for a spa is shown in U.S. Pat. No. 4,839,930. This device provides a flow of water against the inner surface of a diaphragm which provides a massage for a user's neck. A waterproof vibrating cushion is shown in U.S. Pat. No. 4,935,972. It is waterproof and may be used in a spa or a bath tub. It utilizes a vibrator element within a cushion.

While both of these devices provide a degree of neck and shoulder massage, neither is positioned in a spot to utilize the comfortable shape of the spa.

BRIEF SUMMARY OF THE INVENTION

It is an object of the present invention to provide a massager, particularly for the neck and upper shoulder muscles which is mounted in a manner to provide a comfortable neck and upper shoulder massage in a water filled spa.

The present invention is for a neck and upper shoulder massager for mounting in a spa, whirlpool bath or the like. The neck and upper shoulder massager is held in a housing which may be held in or against the sidewall of a spa. The massager has a massager body held in an opening in the sidewall or against the opening in the sidewall of the spa in a waterproof manner so that no water may be passed into the massager body. A waterproof massager diaphragm is held in a watertight manner over a diaphragm opening in the massager body. At least two massagers are held in a moveable manner by the massager body. Each massager has a massager face which contacts an underside of the waterproof massager diaphragm and each of the massagers is supported so that they are capable of moving in an undulating manner under the waterproof massager diaphragm. The massagers may be turned either by a motor held within the massager body, a motor which drives a driven cable within a hollow conduit attached to a remote motor and to the massager body or by water power driving a turbine held within the massager body. The massagers may be rotating angled arms or rotating angled massage wheels or cams.

DESCRIPTION OF THE PREFERRED EMBODIMENTS

Figure 1:
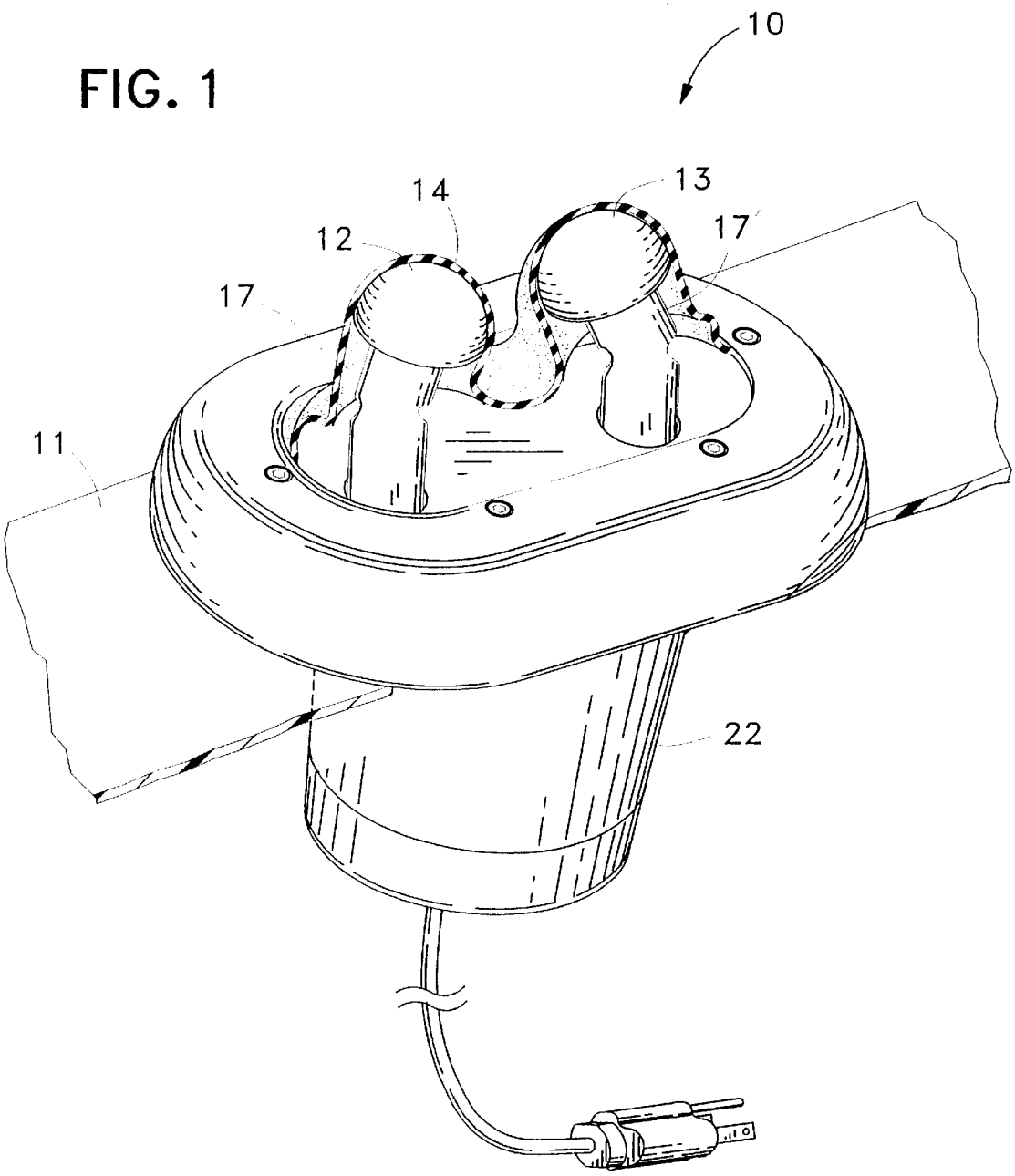
FIG. 1 is a perspective view partially cut away of the neck massager of the present invention.
Figure 2:
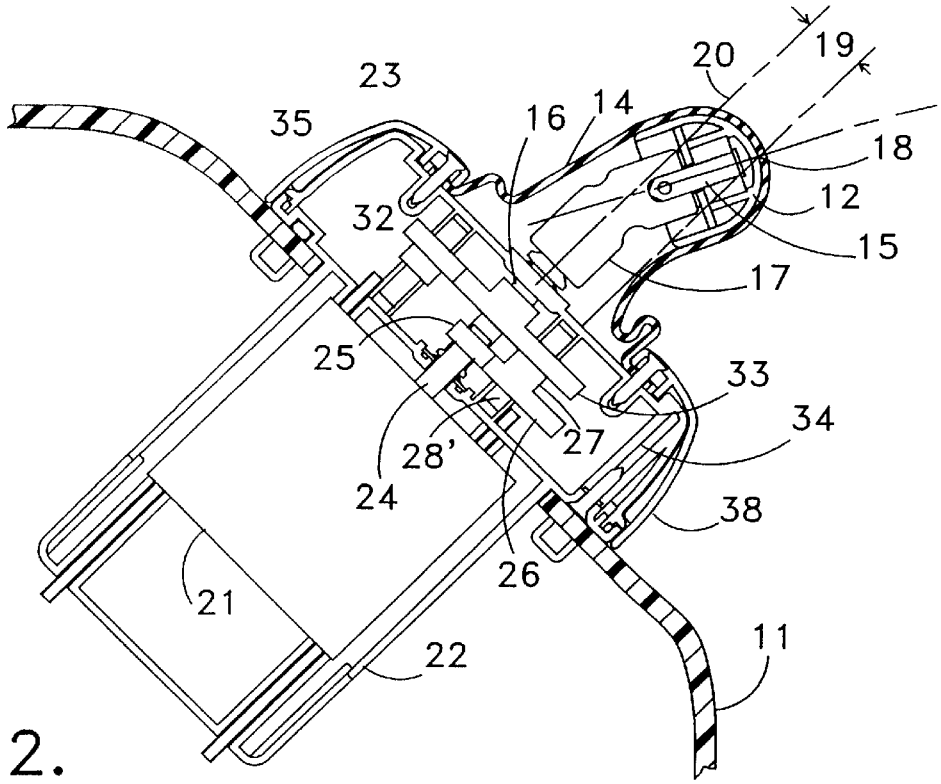
FIG. 2 is a cross-sectional view thereof showing one of the massage knobs.

A neck massager for spas is shown in perspective view in FIG. 1 and indicated generally by reference character 10. The neck massager of FIG. 1 is designed to be mounted in the sidewall of a spa 11 in a waterproof manner. It is preferably mounted at an angle of about 45° to the horizontal. The massager has a pair of knobs 12 and 13 below a flexible diaphragm 14. The inner workings are shown best in FIGS. 2 and 3 where it can be seen that knob 12 is held on a shaft 15 which is turned by a bent fitting 17 affixed to shaft 16. The bent fitting 17 causes the tip 18 of knob 12 to be offset a distance 19 from the axis of rotation 20 of massage arm shaft 16. Distance should be between about 0.5" and 2.0" and preferably about 1.0". Bent fitting 17 is preferably at an angle of about 30°.

Figure 4:
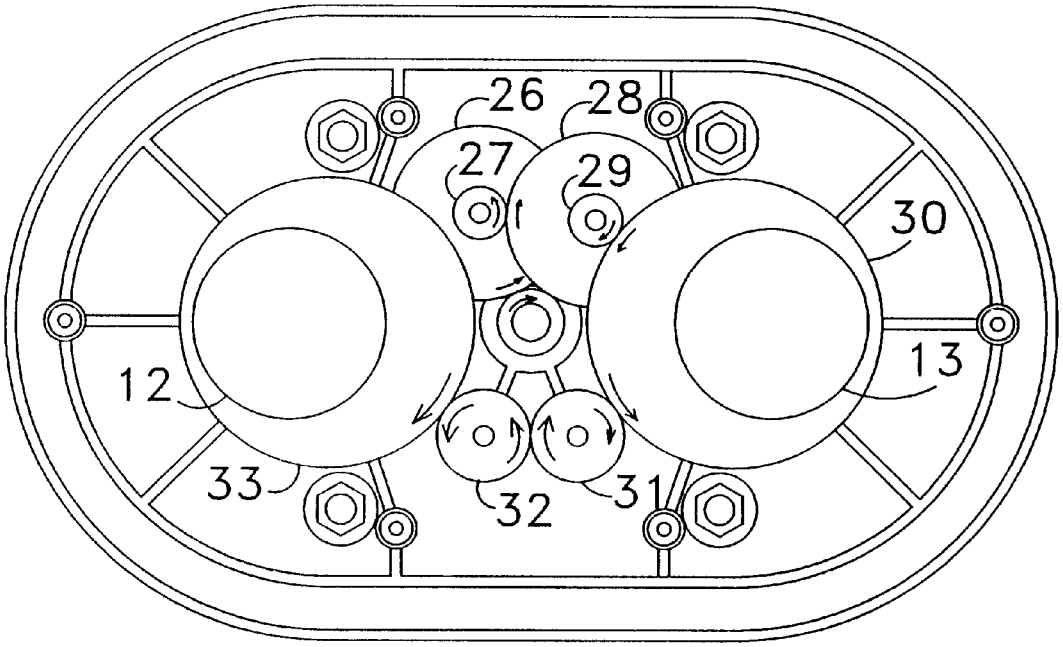
FIG. 4 a top view with the diaphragm removed of the spa of FIG. 1.
Figure 5:
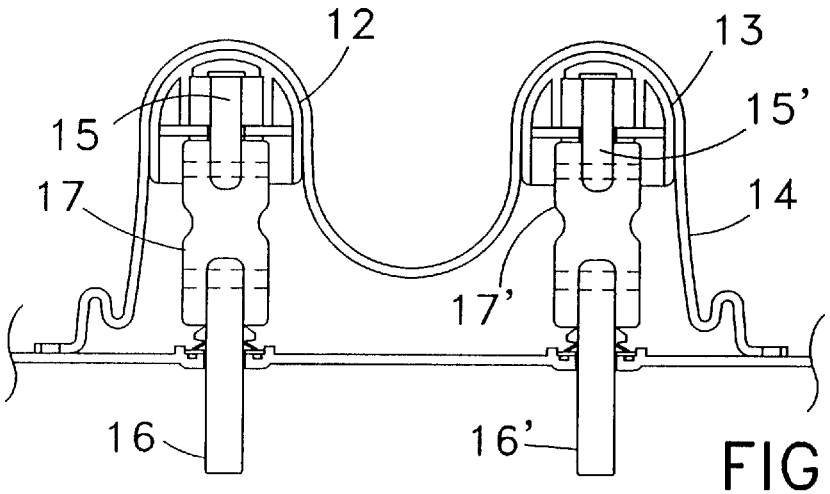
FIG. 5 cross-sectional view of the knobs in a central position.
Figure 6:
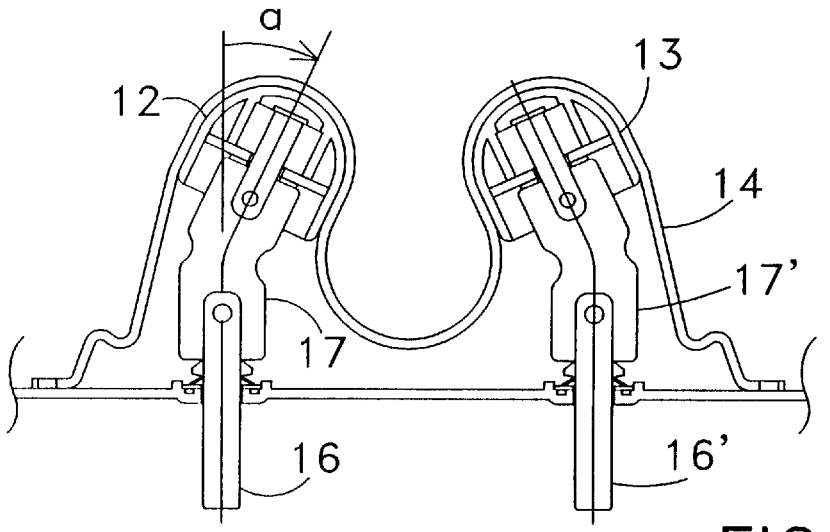
FIG. 6 a cross-sectional view of the knobs in an inner position.
Figure 7:
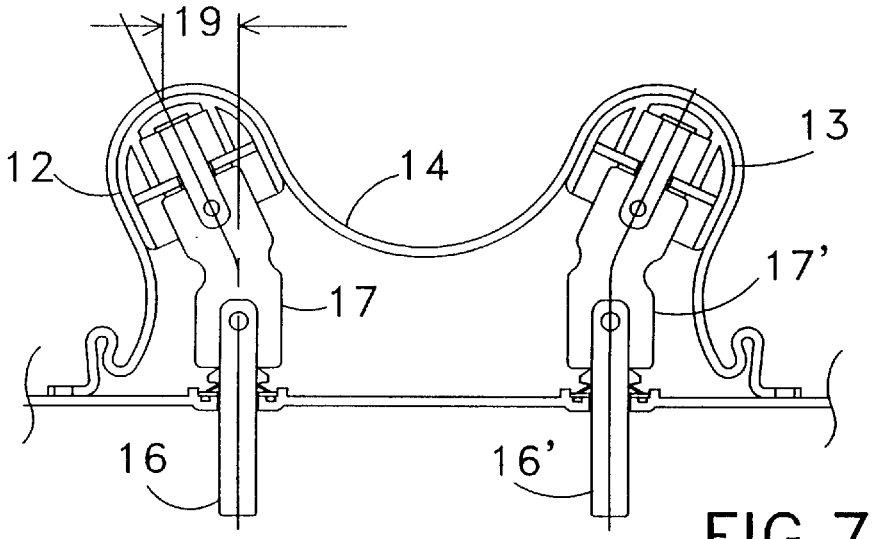
FIG. 7 a cross-sectional view of the knobs in an outer position.

An electric motor 21 is held within housing 22 as are a series of gears 23. Motor 21 has a driven shaft 24 to which an output gear 25 is held. Output gear 25 drives gear 26 which has a smaller gear 27 around the shaft 28' thereof. Smaller gear 27 drives gear 28 which also has a smaller gear 29 in its center. Smaller gear 29 in turn drives gear 30 which is attached to shaft The gear train is shown best in FIG. 4 of the drawings where it can be seen that gear 30 drives a pair of idler gears 31 and 32 which in turn drive gear 33 in the opposite direction from gear 30. With a 1500 RPM motor the massage gears 30 and 33 rotate at a speed of about 30 RPM which provides a slow and pleasant massage action by the movement of knobs 12 and 13 under diaphragm 14.

Diaphragm 14 is fabricated from a flexible material preferably an elastomer such as polyurethane. The diaphragm 14 is preferably waterproof as is the gear box 34 portion of housing 22. Housing 22 is covered by a weatherproof cover 38. An O-ring seal 35 preferably is held by a series of bolts and nuts to the spa shell 11.

Figure 3:
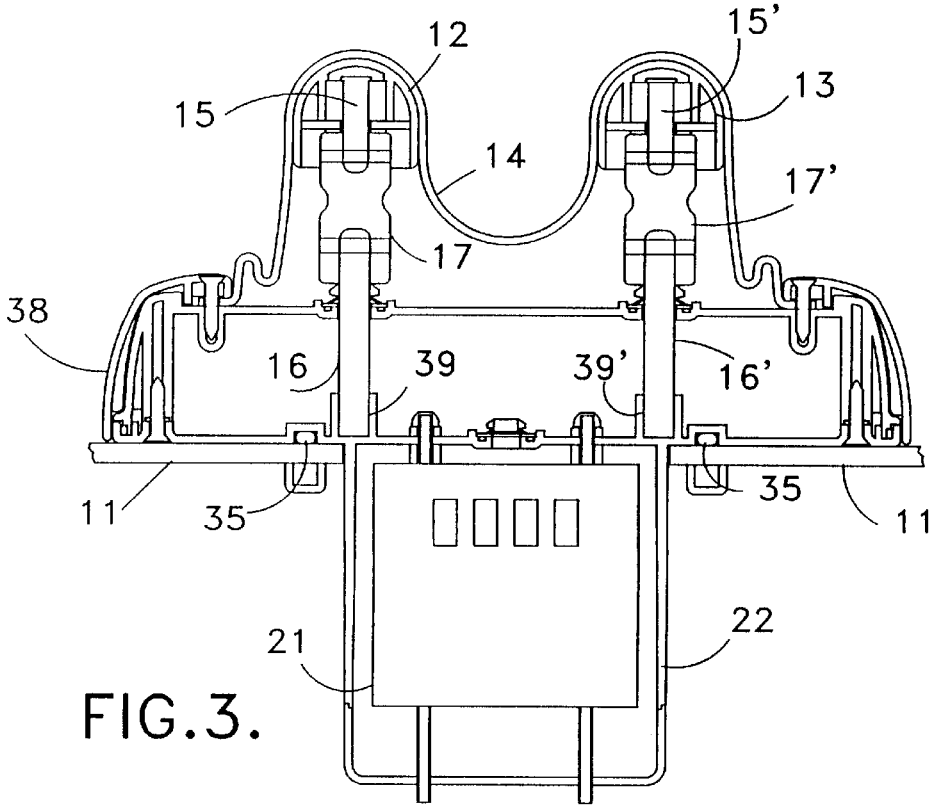
FIG. 3 is a cross-sectional view thereof showing both of the massage knobs.

The unit is shown in FIG. 3 without gears where the support for shafts 16 and 16' can be seen to be held in shaft cups 39 and 39'. The other gears are similarly supported.

The wall mounted massager of the present invention is preferably mounted in a flattened portion of a spa fabricated especially for the use of such massager, although other mounting methods can be used to adapt existing spas to the use of the massager of the present invention. The knobs preferably each have a rounded hemi- spherical ends having a diameter of about 1.5". The knobs are preferably fabricated from a polymer having a high degree of surface slip and abrasion resistance such as nylon, and with the knobs operating in opposite directions, the massaging action is especially effective.

Figure 8:
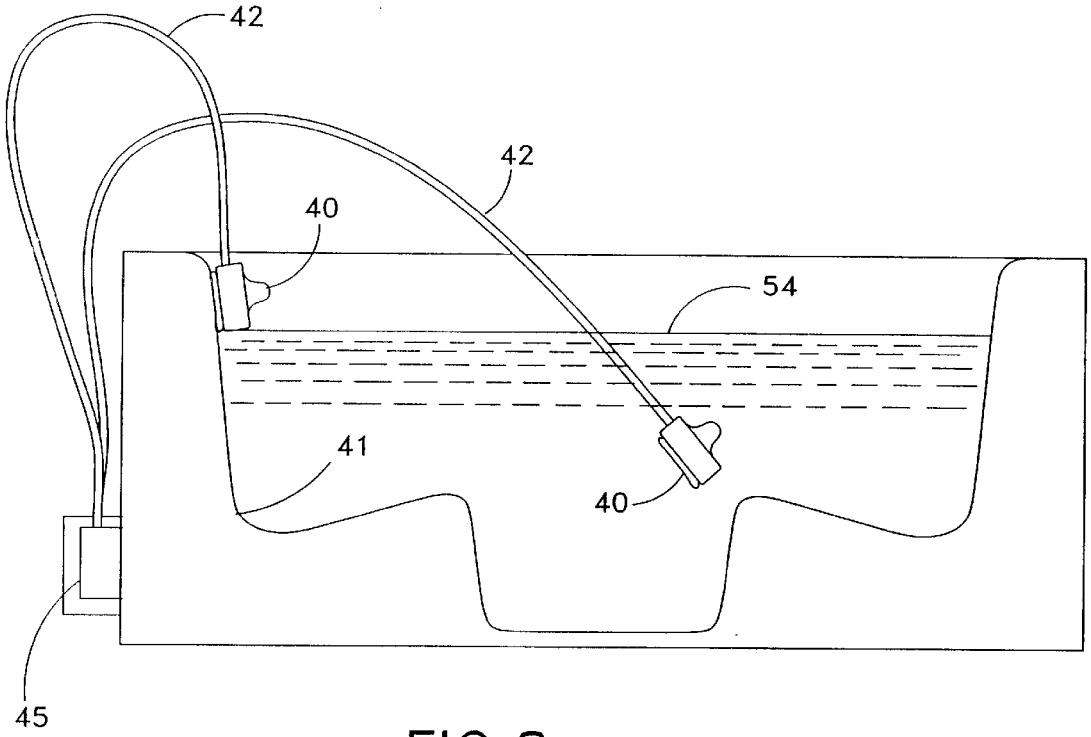
FIG. 8 is diagrammatic side view, partly in cross section, of an alternate embodiment of a massager positioned in a spa.
Figure 9:
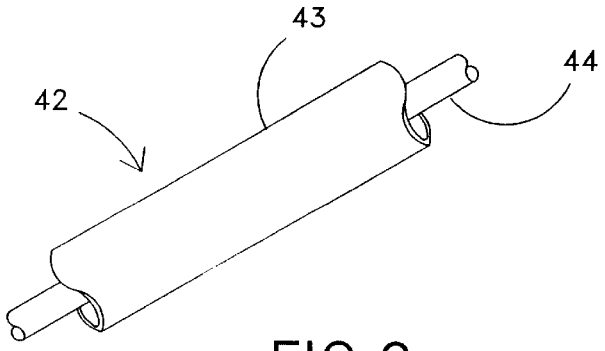
FIG. 9 is an enlarged cross sectional view, partly cut away of the drive-cable of the massager of FIG. 8.

A cable driven version of the massager of the present invention is shown in FIG. 8 and indicated by reference character 40. Two massage units are shown in the spa 41 and these may be hand held or attached to a spa wall by suction cups or other means. The massage unit is identical to that shown in FIGS. 1 through 7 except that in place of motor 21 a drive cable 42 is utilized. Drive cable 42 is flexible and, as shown in FIG. 9 has a stationary outer sleeve or conduit 43 and a rotating inner driven cable 44. Such cables are used in a smaller version as speedometer cables and in larger versions to remotely drive a tool. Inner cable 44 would be attached to driven shaft 24 so that it is driven by inner cable 44 in place of motor 21. Inner cable 44, in turn, is driven by motor 45. Motor 45 is shown attached to an outer portion of spa 41 and is provided with means to protect the motor from the elements and to prevent the motor from being touched by users of the spa. The use of a cable driven massager permits the user to position the massager 40 in any preferred location.

One of the advantages of providing a waterproof diaphragm and body is that the massager 40 can be operated under the surface 54 of the water in the spa. Both the hollow flexible conduit 43 and the body of the massager are waterproof as is the diaphragm. Thus, the massager 40 of FIG. 8 can be positioned at any desirable position.

Figure 10:
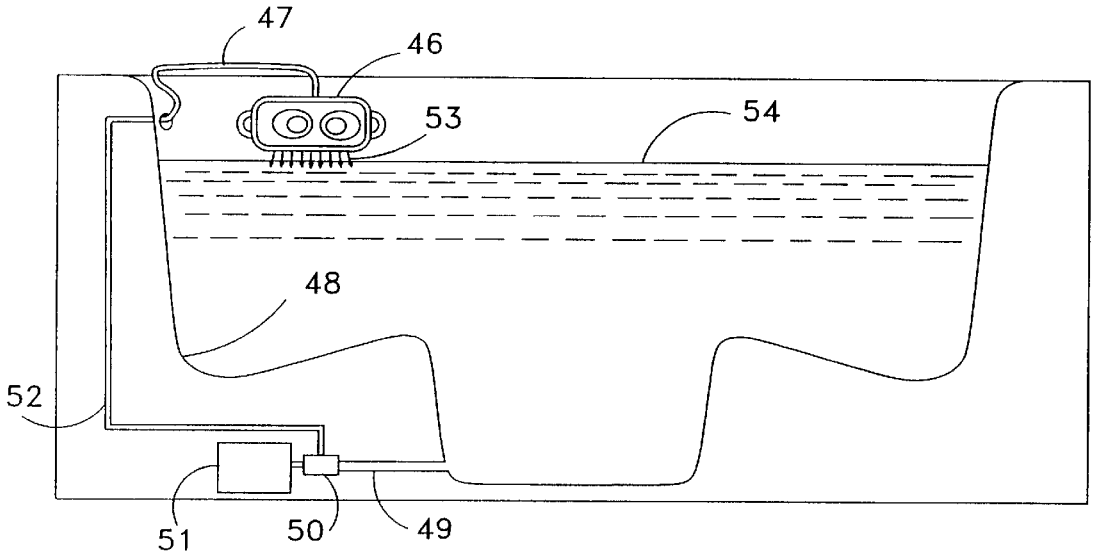
FIG. 10 is a diagrammatic side view, partly in cross section, of a further alternate embodiment of a massager positioned in a spa.

A different version of a hand held massager is shown in FIG. 10 and indicated by reference character 46. Massager 46 is also like massager 40 except that it is driven by a water turbine which turns driven shaft 24. Water is fed through hose 47 into massager 46 which contains a conventional turbine, not shown. Water is supplied from within spa 48 through conduit 49. Conduit 49 is affixed to the inlet of pump 50 which is driven by motor 51. Pump 50 feeds water at a high pressure to conduit 52 which, in turn, is attached to flexible hose 47. The water from the massager turbine simply drains back into the spa as indicated at reference character 53.

Figure 11:
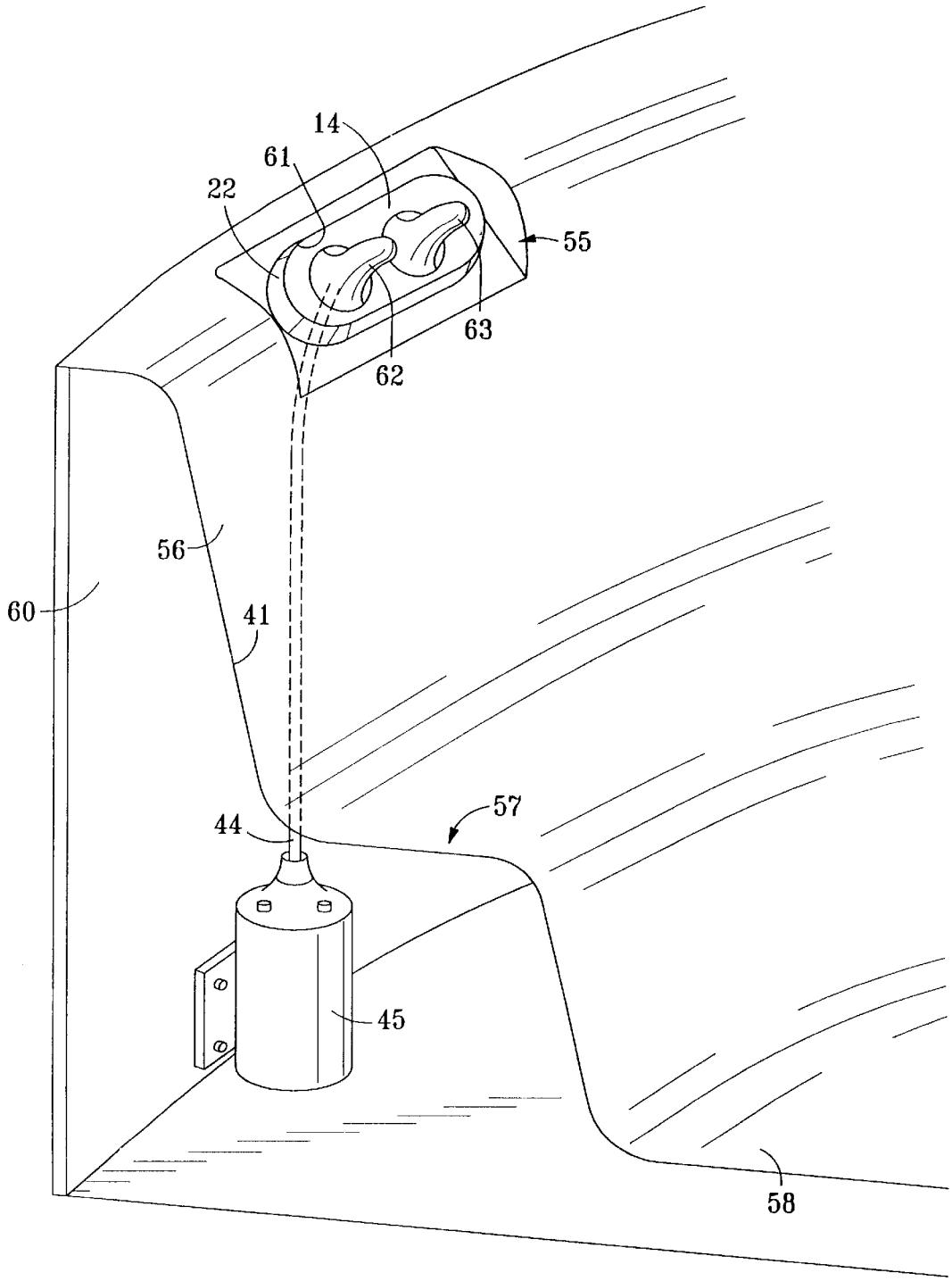
FIG. 11 is a side view partly in cross-section of an alternate embodiment of the neck massager of the present invention.

A spa wall-mounted massager 55 is shown in FIG. 11 and this massager is driven by the hollow flexible cable 42 of FIG. 9. The motor 45 is positioned behind spa wall 56 and at a level below spa seat 57 and above the bottom 58 of spa 41. In this way, motor 45 is protected from any contact by the user. It is shown in FIG. 11 attached to the outer wall 60 of the spa.

The massager body or housing 22 is shown mounted in a manner similar to that shown in FIG. 1 and the diaphragm 14 is held about diaphragm opening 61 in a waterproof manner similar to that shown in FIG. 1. At least two massage arms 62 and 63 are shown in FIG. 11 and they may be of any construction as long as they provide an undulating motion to waterproof diaphragm 14.

Figure 12:
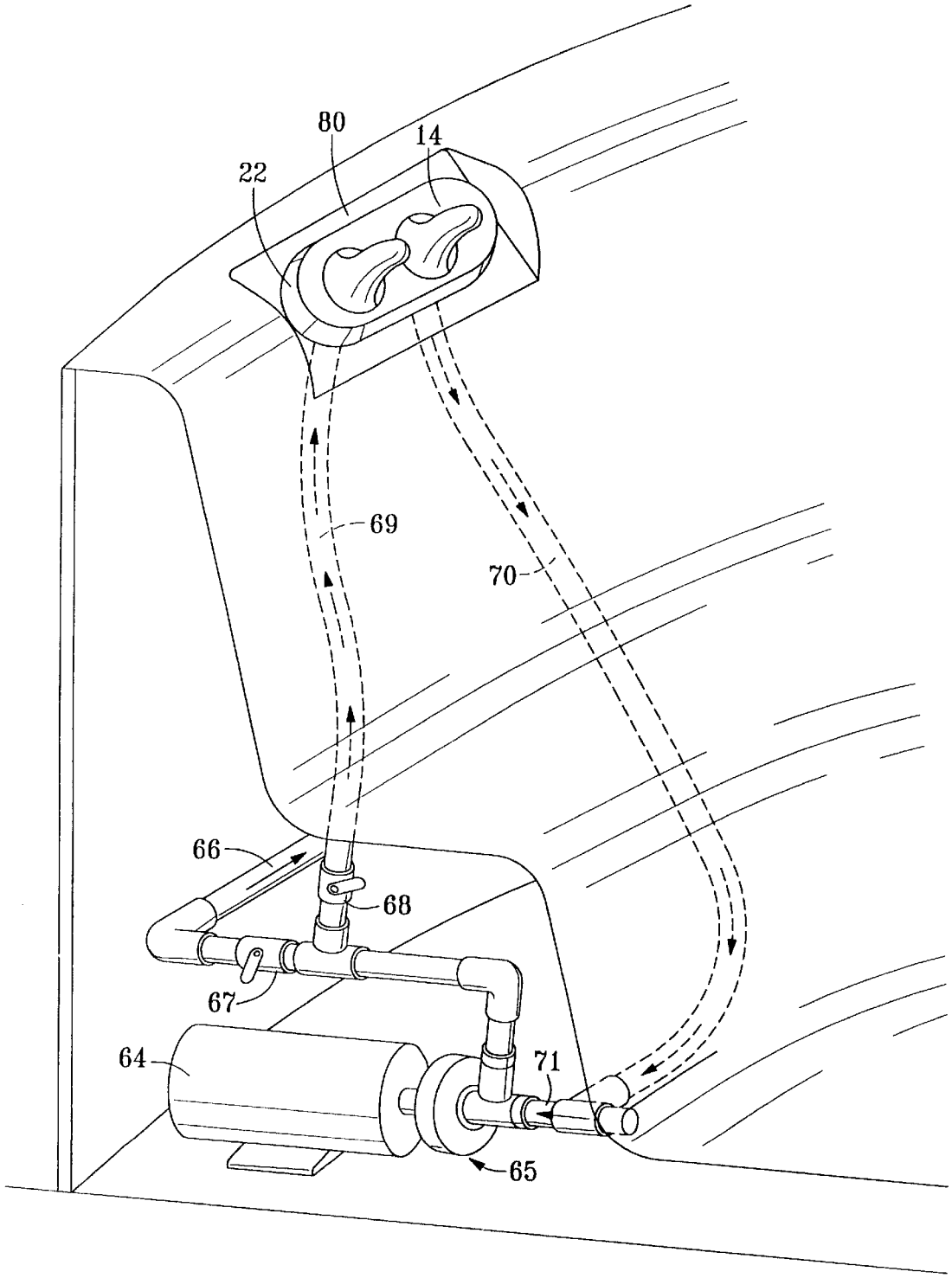
FIG. 12 is a side view of a spa and neck massager of the present invention driven by water power.

A water driven massager is shown in FIG. 12 and the massager body 22 is the same as that shown in FIG. 10. A pump motor 64 drives a high pressure water pump 65 which provides high pressure water to the jets of the spa (not shown) through pipe 66. On/off valves 67 and 68 control the flow of water to the jets and the massager respectively. A conduit 69 feeds water to a turbine turbine drive 80, but of conventional construction which turns the massager arms in a manner similar to that described above. A water outlet conduit 70 is attached to the outlet of the turbine turbine drive 80 and is connected to an inlet line 71 of pump 65.

Figure 13:
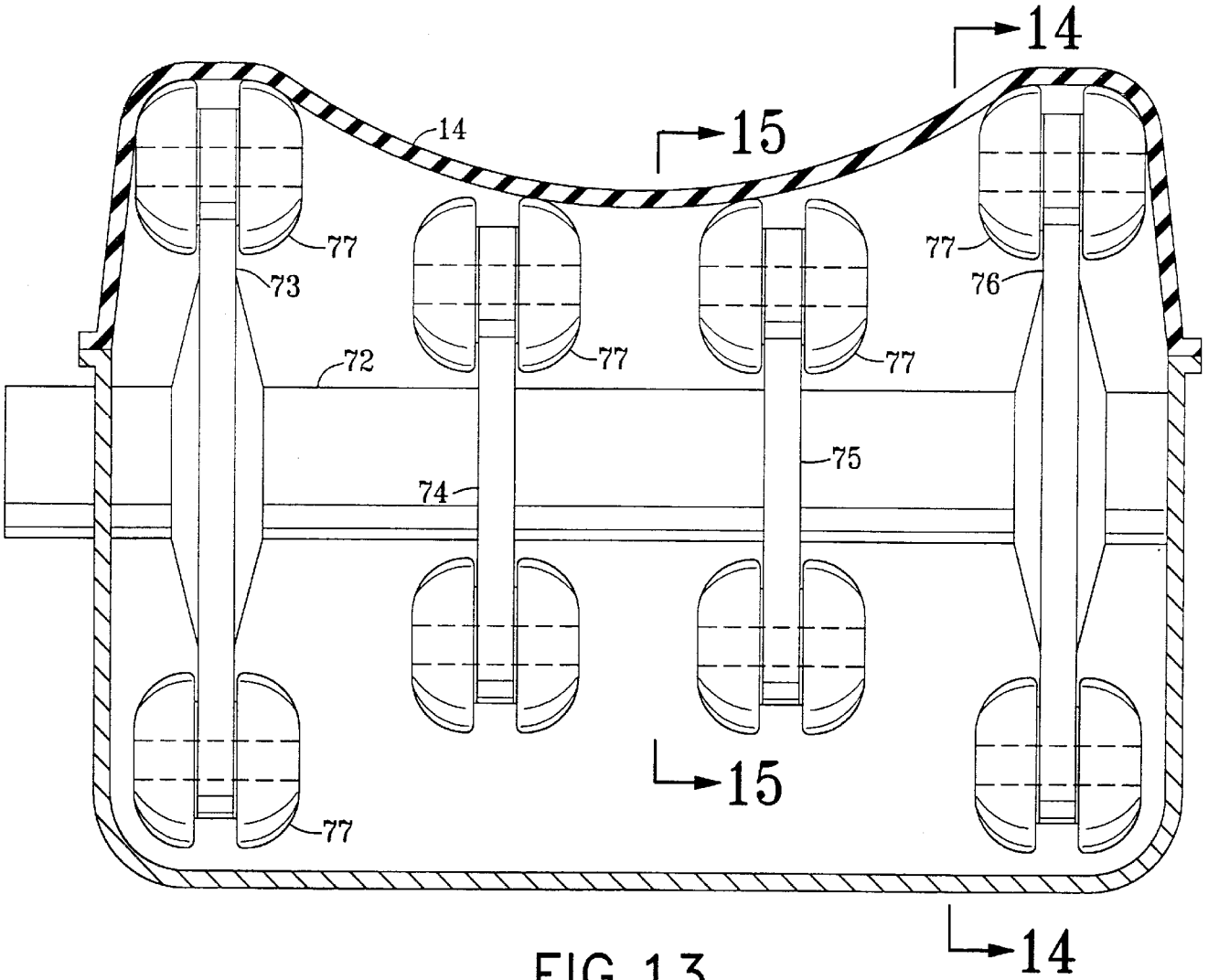
FIG. 13 is a cross-sectional view of an alternate embodiment of the massager arms of the massager of the present invention.
Figure 14:
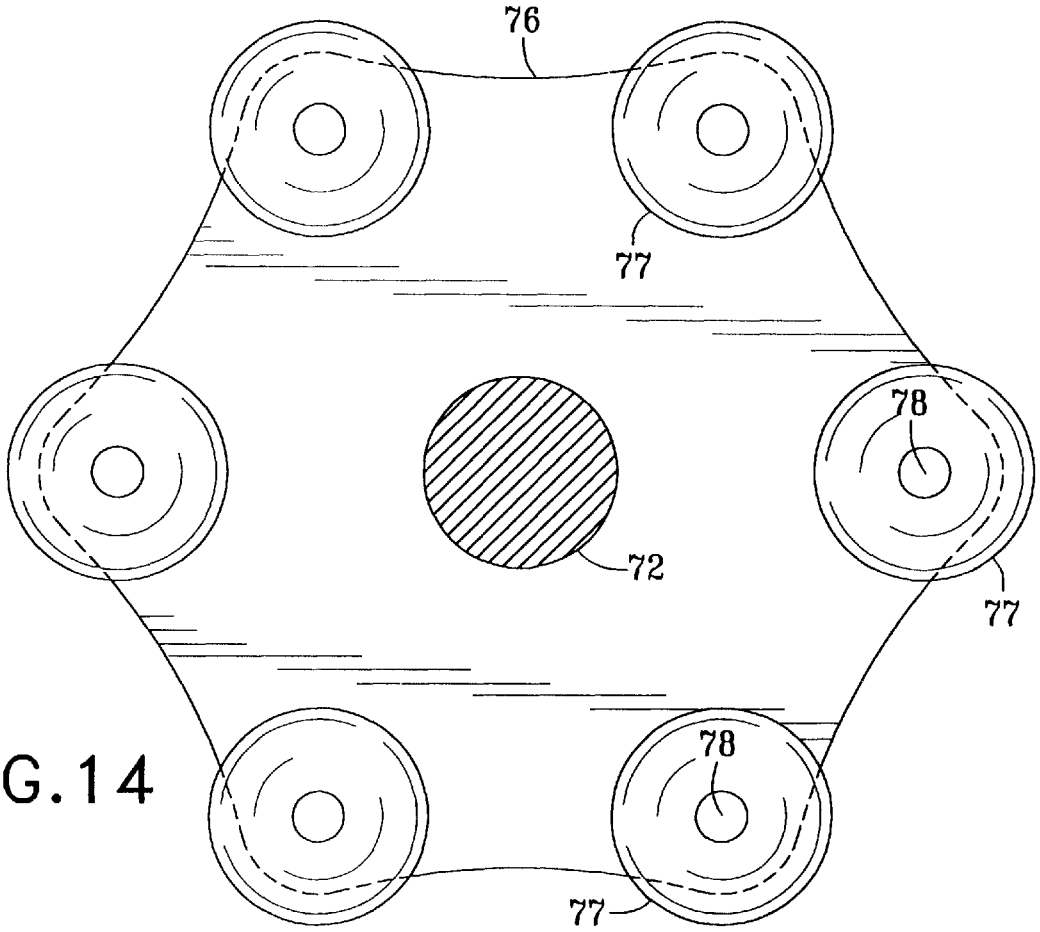
FIG. 14 is a cross-sectional view taken along line 14—14 of FIG. 13.
Figure 15:
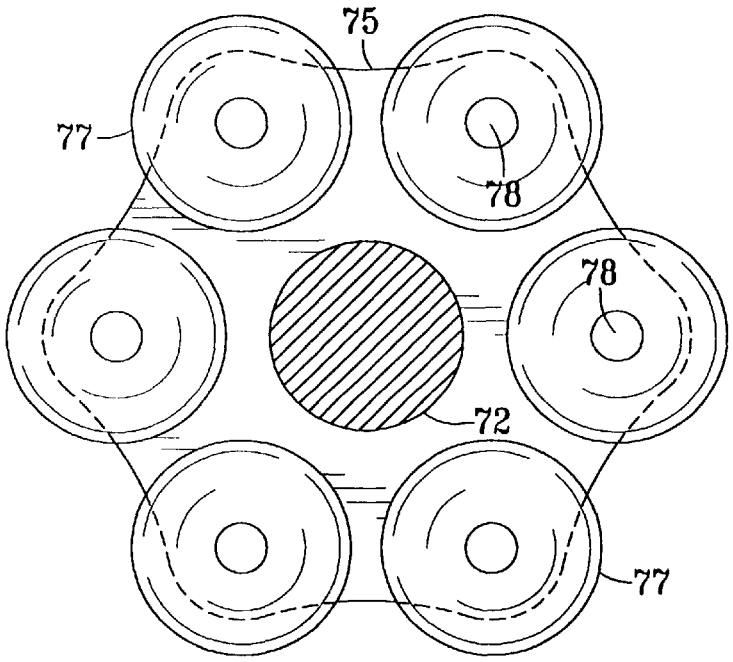
FIG. 15 is a cross-sectional view taken along line 15—15 of FIG. 13.

An alternate embodiment of a massager unit is shown in FIGS. 13, 14 and 15 of the drawings. The massager body supports a massager wheel support shaft 72 to which massage wheels 73, 74, 75 and 76 are rigidly mounted. Wheels 73, 74, 75 and 76 support six rollers 77 rotatingly mounted on axles 78. Massage wheel support shaft 72 is driven by a belt not shown. Rollers 77 cause the flexible diaphragm 14 to undulate and provide a massaging action against the user's neck.

Thus, a neck and upper massager may be held either by a spa wall or against a spa wall and is provided with a waterproof housing and diaphragm so that it may be used in a spa environment. The portable version may be moved to any comfortable position either above the water level or below it and the motor which drives the massager is safely held out of the way below the spa wall.

The present embodiments of this invention are thus to be considered in all respects as illustrative and not restrictive; the scope of the invention being indicated by the appended claims rather than by the foregoing description. All changes which come within the meaning and range of equivalency of the claims are At intended to be embraced therein.

I claim:

1. A neck massager for use in a spa, said neck massager comprising:

a massager body to be held in an opening in a said wall of a spa and said massager body having a diaphragm opening;

a massager diaphragm held over said diaphragm opening;

at least two massagers held in a movable manner by said massager body and said at least two massagers each having a massager face which contacts an underside of said massager diaphragm and each of said at least two massagers being supported so that they are capable of moving in an undulating manner under said massager diaphragm; and p1 means for moving said at least two massagers in an undulating manner comprising:

a turbine drive held by said massager body, said turbine drive being connected to said at least two massagers so that as said turbine drive turns, said at least two massagers are caused to undulate;

a motor;

a water pump driven by said motor, said water pump having an inlet and outlet and said inlet being supplied to a source of water; and a water hose having a first end and a second end and said first end being connected to said outlet of said water pump and said second end being connected to said turbine drive to cause said turbine drive to turn, thereby causing said at least two massagers to undulate.

2. A movable neck massager for use in a spa, said movable neck massager comprising:

a massager body having a spa-contacting base movably held against a side wall of a spa, said massager body being waterproof so that no water may pass into an interior of said massager body, said massager body having a diaphragm opening;

a massager diaphragm held over said diaphragm opening;

at least two massagers held in a movable manner by said massager body and said at least two massagers each having a massager face which contacts an underside of said massager diaphragm and each of said at least two massagers being supported so that they are capable of moving in an undulating manner under said waterproof massager diaphragm; and means for moving said at least two massagers in an undulating manner comprising:

a turbine drive held by said massager body, said turbine drive being connected to at least two massagers so that when said turbine drive turns, said at least two massagers are caused to undulate;

a motor held in a fixed position with respect to said spa;

a water pump driven by said motor, said water pump having an inlet and an outlet and said inlet being supplied to a source of water; and a flexible water hose having a first end and a second end and said first end being connected to said outlet of said water pump and said second end being connected to said turbine drive to cause said turbine to turn, thereby causing said at least two massagers to undulate and permitting said massager body to be placed in a desired position at the end of the flexible water hose.

3. The movable neck massager for use in a spa of claim 2 wherein said at least two massagers comprise a plurality of rollers mounted on each of a plurality of slowly rotating wheels.

4. A movable neck massager for use in a spa of claim 2 wherein there are six rollers mounted on each four wheels.

* * * * *